US011674727B2

(12) United States Patent
De

(10) Patent No.: US 11,674,727 B2
(45) Date of Patent: Jun. 13, 2023

(54) HVAC EQUIPMENT WITH REFRIGERANT GAS SENSOR

(71) Applicant: Goodman Manufacturing Company, L.P., Waller, TX (US)

(72) Inventor: Tathagata De, Houston, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

(21) Appl. No.: 17/384,120

(22) Filed: Jul. 23, 2021

(65) Prior Publication Data

US 2023/0029164 A1 Jan. 26, 2023

(51) Int. Cl.

| | |
|---|---|
| ***F25B 49/02*** | (2006.01) |
| ***F24F 11/36*** | (2018.01) |
| ***F25B 49/00*** | (2006.01) |
| ***F24H 9/20*** | (2022.01) |

(52) U.S. Cl.

CPC ..... *F25B 49/005* (2013.01); *F24F 11/36* (2018.01); *F24H 9/2085* (2013.01); *F25B 2500/222* (2013.01)

(58) Field of Classification Search

CPC ... F25B 49/005; F25B 2500/222; F24F 11/36; F24H 9/2085

See application file for complete search history.

(56) References Cited

U.S. PATENT DOCUMENTS

| | | | | |
|---|---|---|---|---|
| 8,113,062 | B2 | 2/2012 | Graboi et al. | |
| 9,135,705 | B2 | 9/2015 | Chao et al. | |
| 9,528,718 | B2 | 12/2016 | De | |
| 9,825,574 | B2 | 11/2017 | De | |
| 10,544,791 | B2 | 1/2020 | De | |
| 10,704,814 | B2 | 7/2020 | De | |
| 10,740,441 | B2 | 8/2020 | Chu | |
| 10,760,840 | B2 | 9/2020 | Ludwig et al. | |
| 10,948,208 | B2 | 3/2021 | Oka et al. | |
| 2015/0330646 | A1 | 11/2015 | Matsumoto | |
| 2018/0187917 | A1* | 7/2018 | Suzuki | F25B 49/022 |
| 2018/0274832 | A1 | 9/2018 | De et al. | |
| 2019/0226692 | A1 | 7/2019 | Yamada et al. | |
| 2021/0302056 | A1* | 9/2021 | Eskew | F24F 1/0063 |

FOREIGN PATENT DOCUMENTS

| | | | | |
|---|---|---|---|---|
| CN | 108444071 | A * | 8/2018 | F24F 11/64 |
| DE | 102018108581 | A1 * | 10/2019 | |
| GB | 2581386 | A * | 8/2020 | G01M 3/24 |

* cited by examiner

*Primary Examiner* — Jonathan Bradford
(74) *Attorney, Agent, or Firm* — Eubanks PLLC

(57) ABSTRACT

An HVAC system with a refrigerant gas sensor is provided. In one embodiment, an HVAC system includes a heat exchanger coil installed within a housing. The heat exchanger coil is operable to exchange heat with air in the housing via a refrigerant passing through the heat exchanger coil. The system also includes an HVAC sensor assembly installed within the housing. The HVAC sensor assembly includes a refrigerant gas sensor and an orientation sensor positioned to detect an orientation of the refrigerant gas sensor. The HVAC system may also or instead include a position sensor to detect the position of the refrigerant gas sensor within the system. Additional systems, devices, and methods are also disclosed.

16 Claims, 12 Drawing Sheets

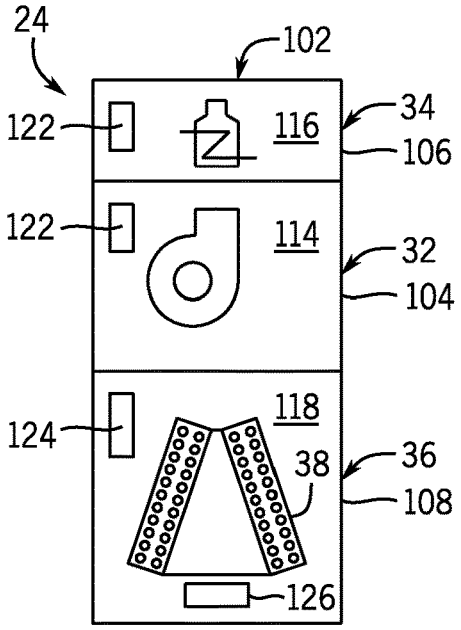
FIG. 3
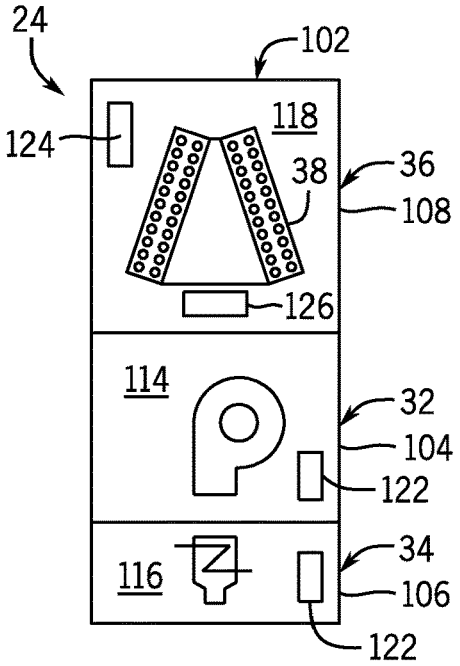
FIG. 4
FIG. 5
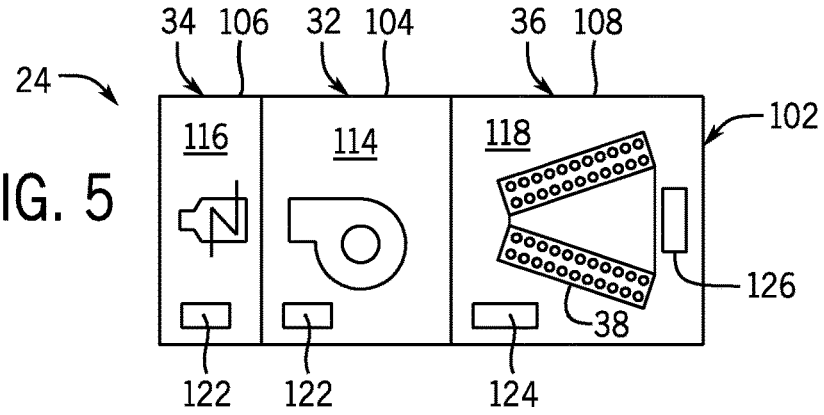
FIG. 6
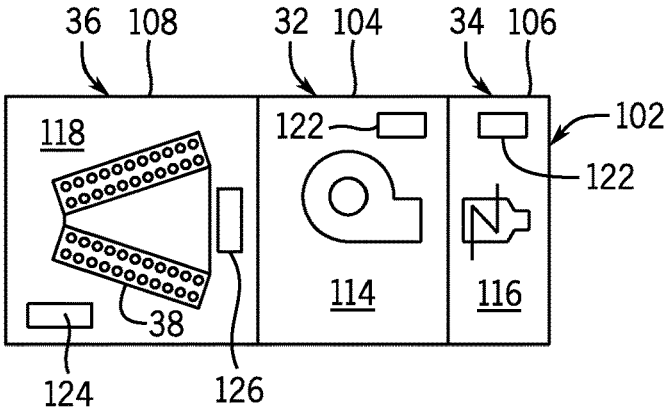

HVAC EQUIPMENT WITH REFRIGERANT GAS SENSOR

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Modern residential and industrial customers expect indoor spaces to be climate controlled. In general, heating, ventilation, and air-conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses a compressor and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air. As would be expected, the heat exchanger providing heating or cooling to the climate-controlled space or structure is described adjectivally as being "indoors," and the heat exchanger transferring heat with the surrounding outdoor environment is described as being "outdoors."

The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side. And the indoor space is heated by doing the opposite, pumping heat from the outdoors to the indoors.

Many North American residences employ "ducted" systems, in which a structure's ambient air is circulated over a central indoor heat exchanger and then routed back through relatively large ducts (or ductwork) to multiple climate-controlled indoor spaces. However, the use of a central heat exchanger can limit the ducted system's ability to vary the temperature of the multiple indoor spaces to meet different occupants' needs. This is often resolved by increasing the number of separate systems within the structure—with each system having its own outdoor unit that takes up space on the structure's property, which may not be available or at a premium.

Residences outside of North America often employ "ductless" systems, in which refrigerant is circulated between an outdoor unit and one or more indoor units to heat and cool specific indoor spaces. Unlike ducted systems, ductless systems route conditioned air to the indoor space directly from the indoor unit—without ductwork. Typically, ductless systems are suited for moderate climates, and are not optimal for climates where robust heating of the indoor space may be desired.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to refrigerant gas sensors for HVAC systems. In some instances, a refrigerant gas sensor is installed in an HVAC system to detect leaking refrigerant, such as from a heat exchanger coil, fitting, or tubing. The HVAC system may be instrumented with one or more additional sensors to detect proper installation of the refrigerant gas sensor. In one embodiment, the HVAC system includes an orientation sensor to detect the orientation of the refrigerant gas sensor. The HVAC system may also or instead include at least one position sensor to detect the location at which the refrigerant gas sensor is installed. If the refrigerant gas sensor is at an undesirable location or orientation, a control system of the HVAC system may respond by taking corrective action, such as stopping or preventing operation of a blower or heating elements until the refrigerant gas sensor is repositioned at a desired location or orientation.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein:

FIG. 3 generally depicts an air handler in an upflow orientation in accordance with one embodiment;

FIG. 4 generally depicts an air handler in a downflow orientation in accordance with one embodiment;

FIG. 5 generally depicts an air handler in a horizontal left orientation in accordance with one embodiment;

FIG. 6 generally depicts an air handler in a horizontal right orientation in accordance with one embodiment;

DETAILED DESCRIPTION OF SPECIFIC EMBODIMENTS

Specific embodiments of the present disclosure are described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
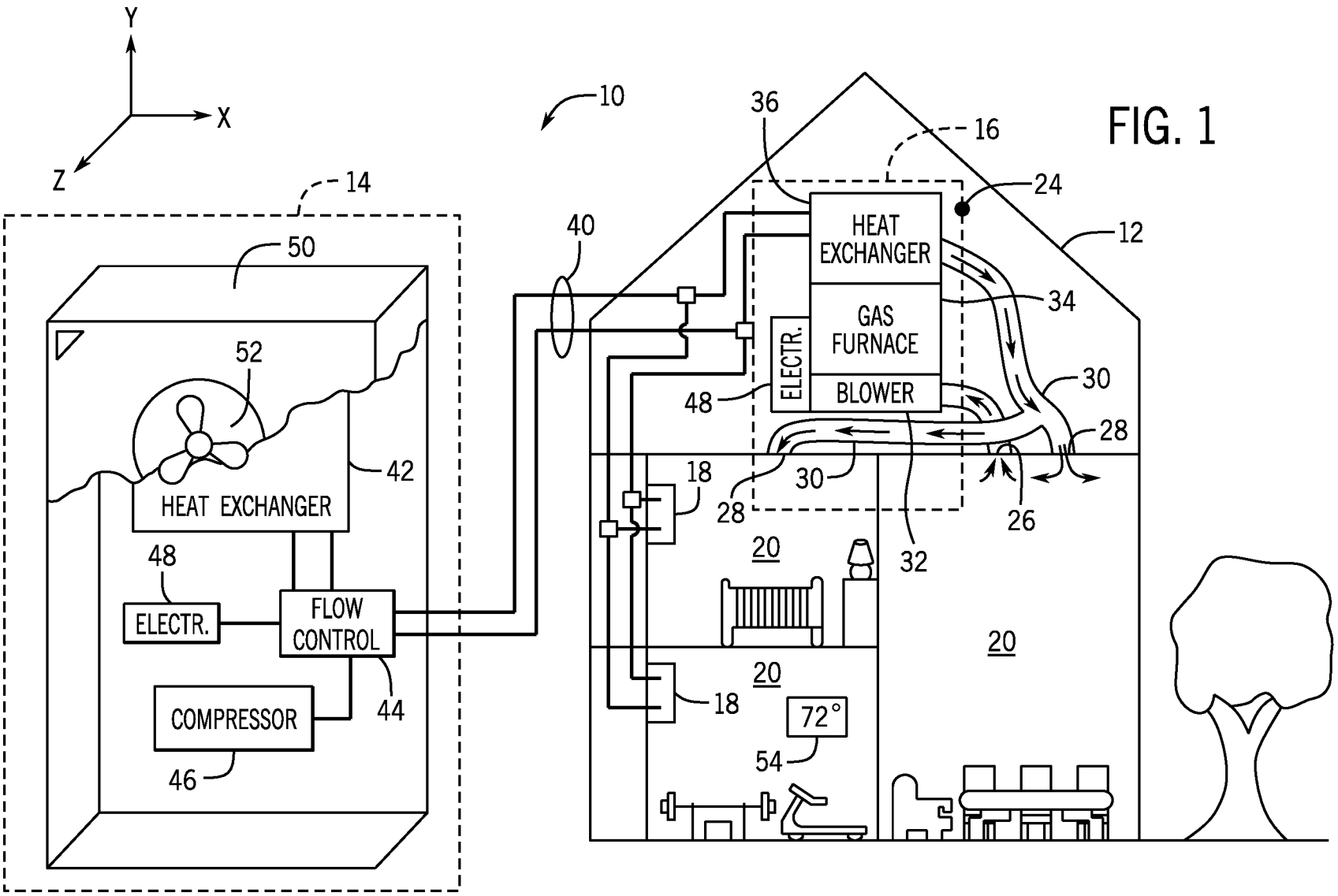
FIG. 1 illustrates schematically an HVAC system for heating and cooling indoor spaces within a structure, in accordance with one embodiment of the present disclosure.

Turning now the figures, FIG. 1 illustrates an HVAC system 10 in accordance with one embodiment. As depicted, the system 10 provides heating and cooling for a residential structure 12. But the concepts disclosed herein are applicable to a myriad of heating and cooling situations, including industrial and commercial settings. And while some HVAC systems provide each of heating, ventilation, and air-conditioning, others do not. The term "HVAC system," as used herein, means a system that provides one or more of heating, ventilation, air conditioning, or refrigeration. For example, an air conditioner that does not provide heating or ventilation is considered an HVAC system. The use of the term "HVAC" in describing a system, unit, component, sensor assembly, equipment, etc., herein is not to be interpreted as a requirement that each of heating, ventilation, and air-conditioning is provided.

The described HVAC system 10 of FIG. 1 divides into two primary portions: the outdoor unit 14, which mainly comprises components for transferring heat with the environment outside the structure 12; and the indoor units 16 & 18, which mainly comprise components for transferring heat with the air inside the structure 12. In the illustrated structure, a ducted indoor unit 16 and ductless indoor units 18 provide heating and cooling to various indoor spaces 20.

Focusing on the ducted indoor unit 16, it has an air-handler unit (or AHU) 24 that provides airflow circulation, which in the illustrated embodiment draws ambient indoor air via a return vent 26, passes that air over one or more heating/cooling elements (i.e., sources of heating or cooling), and then routes that conditioned air, whether heated or cooled, back to the various climate-controlled spaces 20 through supply vents 28. As depicted in FIG. 1, air between the AHU 24 (which may also be referred to as an air handler) and the vents 26 and 28 is carried by ducts or ductwork 30, which are relatively large pipes that may be rigid or flexible. A blower 32 provides the motivational force to generate airflow and circulate the ambient air through the vents 26 and 28, AHU 24, and ducts 30.

As shown, the ducted indoor unit 16 is a "dual-fuel" system that has multiple heating elements. A gas furnace 34, which may be located downstream (in terms of airflow) of the blower 32, combusts natural gas to produce heat in furnace tubes (not shown) that coil through the furnace. These furnace tubes act as a heating element for the ambient indoor air being pushed out of the blower 32, over the furnace tubes, and into supply ducts 30 to supply vents 28. In other instances, the furnace 34 is an electric furnace, with one or more heat strips or other electric heating elements for heating air passing through the AHU 24, rather than a gas furnace. Whether gas or electric, the furnace 34 is generally operated when robust heating is desired. During conventional heating and cooling operations, air from the blower 32 is routed over an indoor heat exchanger 36 and into the supply ducts 30.

The blower 32, furnace 34, and indoor heat exchanger 36 may be packaged as an integrated AHU, or those components may be modular. Moreover, it is envisaged that the positions of the furnace, indoor heat exchanger, and blower can be reversed or rearranged. Internal components of the blower 32, the furnace 34, and the indoor heat exchanger 36 can be positioned within one or more casings, cabinets, or other housings (integrated or modular).

The indoor heat exchanger 36—which in this embodiment for the ducted indoor unit 16 is an A-coil 38 (FIG. 2), as it known in the industry—can act as a heating or cooling element that adds or removes heat from the structure by manipulating the pressure and flow of refrigerant circulating within and between the A-coil 38 and the outdoor unit 14 via refrigerant lines 40.

In the illustrated embodiment of FIG. 1, the state of the A-coil 38 (i.e., absorbing or releasing heat) is the opposite of the outdoor heat exchanger 42. More specifically, if heating is desired, the illustrated indoor heat exchanger 36 acts as a condenser, aiding transition of the refrigerant from a high-pressure gas to a high-pressure liquid and releasing heat in the process. And the outdoor heat exchanger 42 acts as an evaporator, aiding transition of the refrigerant from a low-pressure liquid to a low-pressure gas, thereby absorbing heat from the outdoor environment. If cooling is desired, the outdoor unit 14 has flow-control devices 44 that reverse the flow of the refrigerant—such that the outdoor heat exchanger 42 acts as a condenser and the indoor heat exchanger 36 acts as an evaporator. The outdoor unit 14 also contains other equipment—like a compressor 46, which provides the motivation for circulating the refrigerant, and electrical control circuitry 48, which provides command and control signals to various components of the system 10.

The outdoor unit 14 is a side-flow unit that houses, within a plastic or metal casing or housing 50, the various components that manage the refrigerant's flow and pressure. This outdoor unit 14 is described as a side-flow unit because the airflow across the outdoor heat exchanger 42 is motivated by a fan that rotates about an axis that is non-perpendicular with respect to the ground. In contrast, "up-flow" devices generate airflow by rotating a fan about an axis generally perpendicular to the ground. (As illustrated, the Y-axis is perpendicular to the ground.) In one embodiment, the side-flow outdoor unit 14 may have a fan 52 that rotates about an axis that is generally parallel to the ground. (As illustrated, the X- and Z-axes are parallel to the ground.) It is envisaged that either up-flow or side-flow units could be employed. Advantageously, the side-flow outdoor unit 14 provides a smaller footprint than traditional up-flow units, which are more cubic in nature.

In addition to the ducted indoor unit 16, the illustrated HVAC system has ductless indoor units 18 that also circulate refrigerant, via the refrigerant lines 40, between the outdoor heat exchanger 42 and the ductless indoor unit's heat exchanger. The ductless indoor units 18 may work in conjunction with or independent of the ducted indoor unit 16 to heat or cool the given indoor space 20. That is, the given indoor space 20 may be heated or cooled with the structure's air that has been conditioned by the ductless indoor unit 18 and by the air routed through the ductwork 30 after being conditioned by the A-coil 38, or it may be entirely conditioned by the ductless indoor unit or the ducted indoor unit working independent of one another. As another embodiment, the A-coil refrigerant loop may be operated to provide cooling or heating only—and the ductless indoor units may also be designed to provide cooling or heating only.

As is well known, the HVAC system may be in communication with a thermostat 54 that senses the indoor space's temperature and allows the structure occupants to "set" the desired temperature for that sensed indoor space. The thermostat may be operate using a simple on/off protocol that sends 24V signals, for example, to the HVAC system to either activate or deactivate various components; or it may be a more complex thermostat that uses a "communicating protocol," such as ClimateTalk or P1/P2, that sends and receives data signals and can provide more complex operating instructions to the HVAC system.

Figure 2:
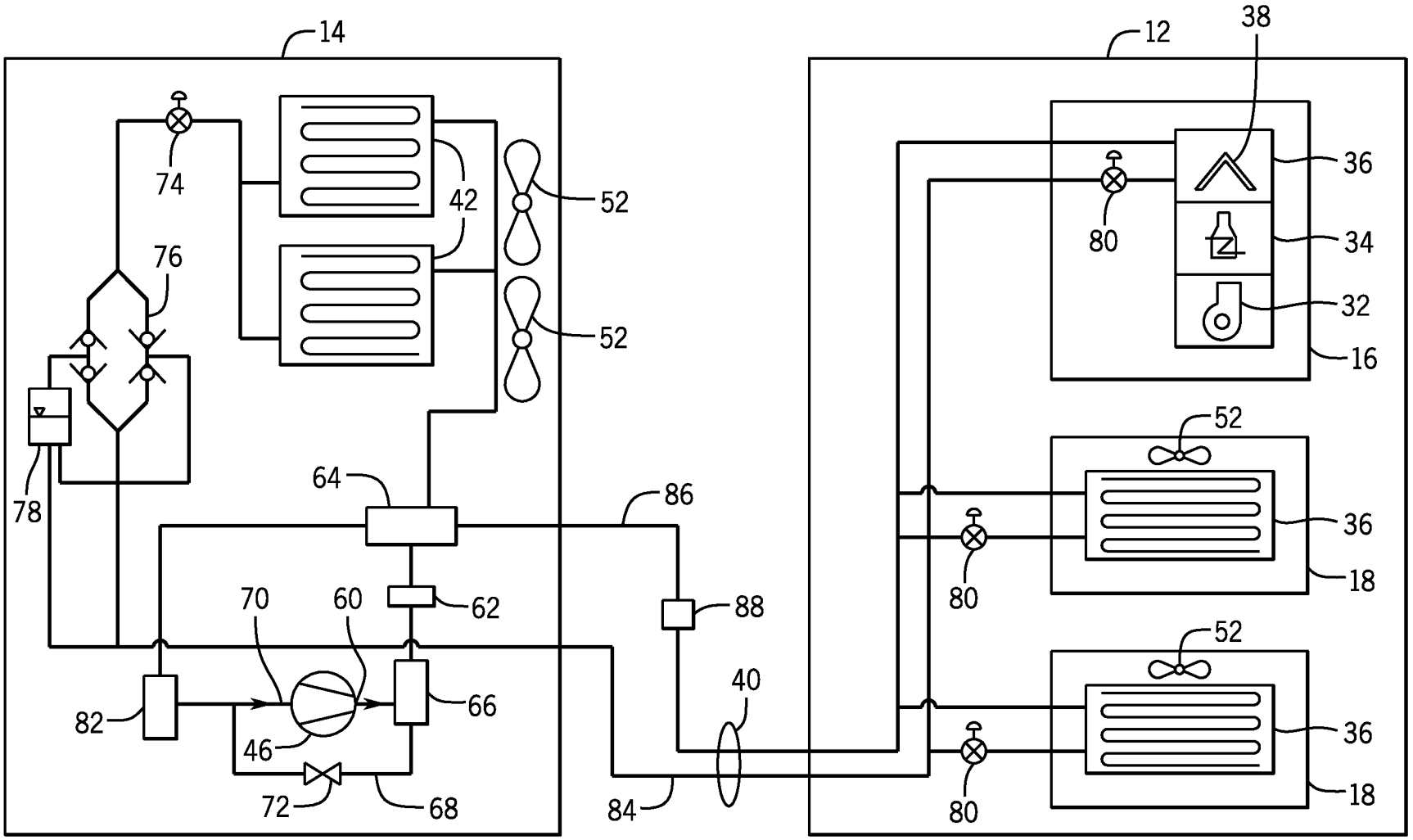
FIG. 2 is a schematic process-and-instrumentation drawing of an HVAC system for heating and cooling indoor spaces within a structure, in accordance with one embodiment.

FIG. 2 provides further detail about the various components of an HVAC system and their operation. The compressor 46 draws in gaseous refrigerant and pressurizes it, sending it into the closed refrigerant loop 40 via compressor outlet 60. (A flow meter 62 may be used to measure the flow of refrigerant out of the compressor.) The outlet 60 is connected to a reversing valve 64, which may be electronic, hydraulic, or pneumatic and which controls the routing of the high-pressure gas to the indoor or outdoor heat exchangers. Moreover, the outlet 60 may be coupled to an oil separator 66 that isolates oil expelled by the compressor and, via a return line 68, returns the separated oil to the compressor inlet 70—to help prevent that expelled oil from reaching the downstream components and helping ensure the compressor maintains sufficient lubrication for operation. The oil return line 68 may include a valve 72 that reduces the pressure of the oil returning to the compressor 46.

To cool the structure, the high-pressure gas is routed to the outdoor heat exchangers 42, where airflow generated by the fans 52 aids the transfer of heat from the refrigerant to the environment—causing the refrigerant to condense into a liquid that is at high-pressure. As shown, the outdoor unit 14 has multiple heat exchangers 42 and fans 52 connected in parallel, to aid the HVAC system's operation.

The refrigerant leaving the heat exchangers 42 is or is almost entirely in the liquid state and flows through or bypasses a metering device 74. From there, the high-pressure liquid refrigerant flows into a series of receiver check valves 76 that manage the flow of refrigerant into the receiver 78. The receiver 78 stores refrigerant for use by the system and provides a location where residual high-pressure gaseous refrigerant can transition into liquid form. And the receiver may be located within the casing 50 of the outdoor unit or may be external to the casing 50 of the outdoor unit. (Or the system may have no receiver at all.) From the receiver 78, the high-pressure liquid refrigerant flows to the indoor units 16, 18, specifically to metering devices 80 that restrict the flow of refrigerant into each heat exchanger of the indoor units 16, 18, to reduce the refrigerant's pressure. The refrigerant leaves the indoor metering devices 80 as a low-pressure liquid. In the described embodiment, the metering device 80 is an electronic expansion valve, but other types of metering devices—like capillaries, thermal expansion valves, reduced orifice tubing—are also envisaged. Electronic expansion valves provide precise control of refrigerant flow into the heat exchangers of the indoor units, thus allowing the indoor units—in conjunction with the compressor—to provide individualized cooling for the given indoor space 20 the unit is assigned to.

Low-pressure liquid refrigerant is then routed to the indoor heat exchangers 36. As illustrated, the indoor heat exchanger 36 for the ducted indoor unit 16 is an "A-coil" style heat exchanger 38. But the heat exchanger 38 can be an "N-coil" (or "Z-coil") style heat exchanger or a slab coil or can take any other suitable form. Airflow generated by the blower 32 aids in the absorption of heat from the flowing air by the refrigerant, causing the refrigerant to transition from a low-pressure liquid to a low-pressure gas as it progresses through the indoor heat exchanger 36. And the airflow generated by the blower 32 drives the now cooled air into the ductwork 30 (specifically the supply ducts), cooling the indoor spaces 20. In a similar fashion, the low-pressure liquid refrigerant is routed to the indoor heat exchangers 36 of the ductless indoor units 18, where it is evaporated, causing the refrigerant to absorb heat from the environment. However, unlike the ducted indoor unit, the ductless indoor units circulate air without ductwork, using a local fan 52, for example.

The refrigerant leaving the indoor heat exchangers 36, which is now entirely or mostly a low-pressure gas, is routed to the reversing valve 64 that directs refrigerant to the accumulator 82. Any remaining liquid in the refrigerant is separated in the accumulator, ensuring that the refrigerant reaching the compressor inlet 70 is almost entirely in a gaseous state. The compressor 46 then repeats the cycle, by compressing the refrigerant and expelling it as a high-pressure gas.

For heating the structure 12, the process is reversed. High-pressure gas is still expelled from the compressor outlet 60 and through the oil separator 66 and flow meter 62. However, for heating, the reversing valve 64 directs the high-pressure gas to the indoor heat exchangers 36. There, the refrigerant—aided by airflow from the blower 32 or the fans 52—transitions from a high-pressure gas to a high-pressure liquid, expelling heat. And that heat is driven by the airflow from the blower 32 into the ductwork 30 or by the fans 52 in the ductless indoor units 18, heating the indoor spaces 20. If more robust heating is desired, the gas furnace 34 may be ignited, either supplementing or replacing the heat from the heat exchanger. That generated heat is driven into the indoor spaces by the airflow produced by the blower 32. In other instances, electric heating elements (e.g., of an electric furnace 34 of the indoor units 16 or 18) may also or instead be used to provide heat to the indoor spaces 20.

The high-pressure liquid refrigerant leaving each indoor heat exchanger 36 is routed through or past the given metering valve 80, which is, in this embodiment, an electronic expansion valve. But for other embodiments, the valve may be any other type of suitable expansion valve, like a thermal expansion valve or capillary tubes, for example. Using the refrigerant lines 40, the high-pressure liquid refrigerant is routed to the receiver check valves 76 and into the receiver 78. As described above, the receiver 78 stores liquid refrigerant and allows any refrigerant that may remain in gaseous form to condense. From the receiver, the high-pressure liquid refrigerant is routed to an outdoor metering device 74, which lowers the pressure of the liquid. Just like the indoor metering device 80, the illustrated outdoor metering device 74 is an electrical expansion valve. But it is envisaged that the outdoor metering device could be any number of devices, including capillaries, thermal expansion valves, reduced orifice tubing, for example.

The lower-pressure liquid refrigerant is then routed to the outdoor heat exchangers 42, which are acting as evaporators. That is, the airflow generated by the fans 52 aids the transition of low-pressure liquid refrigerant to a low-pressure gaseous refrigerant, absorbing heat from the outdoor environment in the process. The low-pressure gaseous refrigerant exits the outdoor heat exchanger 42 and is routed to the reversing valve 64, which directs the refrigerant to the accumulator 82. The compressor 46 then draws in gaseous refrigerant from accumulator 82, compresses it, and then expels it via the outlet 60 as high-pressure gas, for the cycle to be repeated.

As illustrated in FIG. 2, the system is a "two-pipe" variable refrigerant flow system, in which the HVAC system's refrigerant is circulated between the outdoor and indoor units via two refrigerant lines 40, one of which is a line that carries predominantly liquid refrigerant (a liquid line 84) and one of which is a line that carries predominately gas refrigerant (a gas line 86). However, it is also envisaged that, in other embodiments, aspects described herein could be applied to a three-pipe variable refrigerant flow system, in which in addition to the gas and liquid lines a third discharge line aids in the circulation of refrigerant.

In many instances, the structure 12 may have had a previous HVAC system with pre-existing refrigerant piping at least partially built into the structure's interior walls. For example, the pre-existing system may be a traditional HVAC unit that uses circulating refrigerant for cooling only and a gas furnace for heating, with all of the conditioned air delivered to the interior spaces via the ductwork. And the pre-existing refrigerant lines—which are built into the walls of the structure—may have a gas line with a ⅝-inch, ⅞-inch, or ⅜-inch outer diameter gas line. However, in certain embodiments, the outdoor unit 14 may have more modern refrigerant piping, which tends to be smaller in outer diameter. For example, the outdoor unit 14 may be 2-, 3-, or 4-Ton unit that has a gas line diameter of ⅝ inch. It would be laborious and cost ineffective to replace the pre-existing gas line in the structure with ⅝-inch diameter tubing. Accordingly, the illustrated HVAC system includes a coupler 88 that helps couple the varying diameter gas lines to one another. For example, the coupler 88 may facilitate coupling of the outdoor unit's ⅝-inch diameter gas line to the structure's pre-existing ⅝-inch, ⅞-inch, or ⅜-inch diameter gas line. In another embodiment, the outdoor unit 14 may be a 5-Ton unit with a gas line having a diameter of ⅝ inch. The coupler could facilitate coupling of this outdoor unit with a pre-existing gas line of ⅞-inch or ⅜-inch diameter.

Additional examples of an air handler 24 in various orientations are generally provided in FIGS. 3-6. These figures show the air handler 24 including a blower 32, a gas or electric furnace 34, and an indoor heat exchanger 36 with a coil 38. The depicted air handler 24 includes a cabinet 102 housing internal components, such as the coil 38, a blower fan, electric heating strips (or furnace tubes), and electronic control circuitry. More specifically, the blower 32 includes a cabinet 104 with internal volume 114, the furnace 34 includes a cabinet 106 with internal volume 116, and the heat exchanger 36 includes a cabinet 108 with internal volume 118. The blower fan, furnace heating elements, and coil 38 are generally depicted in volumes 114, 116, and 118, respectively.

As noted above, the blower 32, the furnace 34, and the heat exchanger 36 may be packaged as an integrated air handler 24 or these components may be modular. The cabinets 104, 106, and 108 may be portions of the cabinet 102. In a modular system, individual cabinets 104, 106, and 108 can be connected directly together or may be connected with intermediate components, such as transition ducts. In some instances, the air handler 24 includes cabinets 104 and 106, packaged as a single unit having a blower fan and furnace, and a cabinet 108 that is a separate module having coil 38. In such a system, the cabinet 108 may be connected directly or indirectly (e.g., via a transition duct) to the single unit of cabinets 104 and 106. The air handler cabinet 102 includes the cabinets 104, 106, and 108, any intermediate components (e.g., transitions) between the cabinets 104, 106, and 108, and any plenums (e.g., return or supply plenum boxes) connecting the ductwork 30 with the air handler 24. The cabinets 104, 106, and 108 have sheet metal walls in at least some cases and may include access doors.

Various electronic control circuitry, such as one or more electronic controllers 122, may be installed with the air handler 24. In at least some embodiments, the air handler 24 includes a controller 122 installed within the cabinet 102. The controller 122 can take any suitable form but in some embodiments is provided as a control board (e.g., a printed circuit board having a processor) that controls operation of some or all functions of the air handler 24, such as controlling the blower fan, operating mode, gas flow, and ignition within the air handler 24.

The air handler 24 may be installed in various configurations, such as an upflow air handler (FIG. 3), a downflow air handler (FIG. 4), a horizontal left air handler (FIG. 5), or a horizontal right air handler (FIG. 6). Although the air handler 24 may be designed for installation and operation in one particular orientation, such as an upflow orientation, in at least some embodiments the air handler 24 is designed to facilitate installation in multiple orientations, such as some or all of the orientations depicted in FIGS. 3-6. The air handler 24 may be designed to facilitate installation in any of the upflow, downflow, horizontal left, and horizontal right orientations, for instance, or may be designed to facilitate installation in a subset of these orientations, such as in an upflow or horizontal orientation.

In at least some embodiments, an HVAC system includes a refrigerant gas sensor positioned to detect leaking refrigerant within the system, such as refrigerant leaking from the coil 38 or from piping, fittings, or other connections between the coil 38 and the refrigerant lines 40. In FIGS. 3-6, for instance, refrigerant gas sensors 124 and 126 are positioned within the cabinet 102 of the air handler 24. While these refrigerant gas sensors 124 and 126 are shown near the coil 38 within the cabinet 108 of the heat exchanger 36, either or both sensors could be located in the cabinet 104, the cabinet 106, or elsewhere in the system. And while two refrigerant gas sensors are depicted in FIGS. 3-6, other embodiments may include more refrigerant gas sensors or only a single refrigerant gas sensor.

Refrigerant gas sensors, such as sensors 124 and 126, can be positioned at any suitable location and orientation in an HVAC system. These sensors can be installed at fixed locations in the air handler 24, such as to a wall of the cabinet 102, to the coil 38, or to some other internal component. Sensitivity of at least some refrigerant gas sensors, however, depends on orientation of the sensors. Some sensors, for instance, may be most sensitive when positioned in a horizontal orientation. Others may be most sensitive when positioned in a vertical orientation, while still others could be most sensitive when positioned at some other orientation between horizontal and vertical. The refrigerant gas sensors 124 and 126 are generally shown in FIGS. 3-6 to be installed in different orientations. In FIGS. 3 and 4 with the air handler 24 in an upright orientation, the sensor 124 is depicted in a vertical orientation and the sensor 126 is depicted in a horizontal orientation. When the air handler 24 is instead positioned in a horizontal orientation as in FIGS. 5 and 6, the orientations of the sensors are reversed—the sensor 124 is in a horizontal orientation and the sensor 126 is in a vertical orientation.

The sensors 124 and 126 are most sensitive in the same orientation (e.g., horizontal) in some embodiments. In such instances, the sensors 124 and 126 can be installed in different orientations, such as perpendicular to one another, so that one the sensors 124 or 126 will be more sensitive when the air handler 24 is installed upright, while the other sensor will be more sensitive when the air handler 24 is installed horizontally. Although two refrigerant sensors are depicted in FIGS. 3-6, more sensors 124 or 126 could be installed in the air handler 24 for additional sensing. In other instances, a single refrigerant gas sensor could be used.

Figure 7:
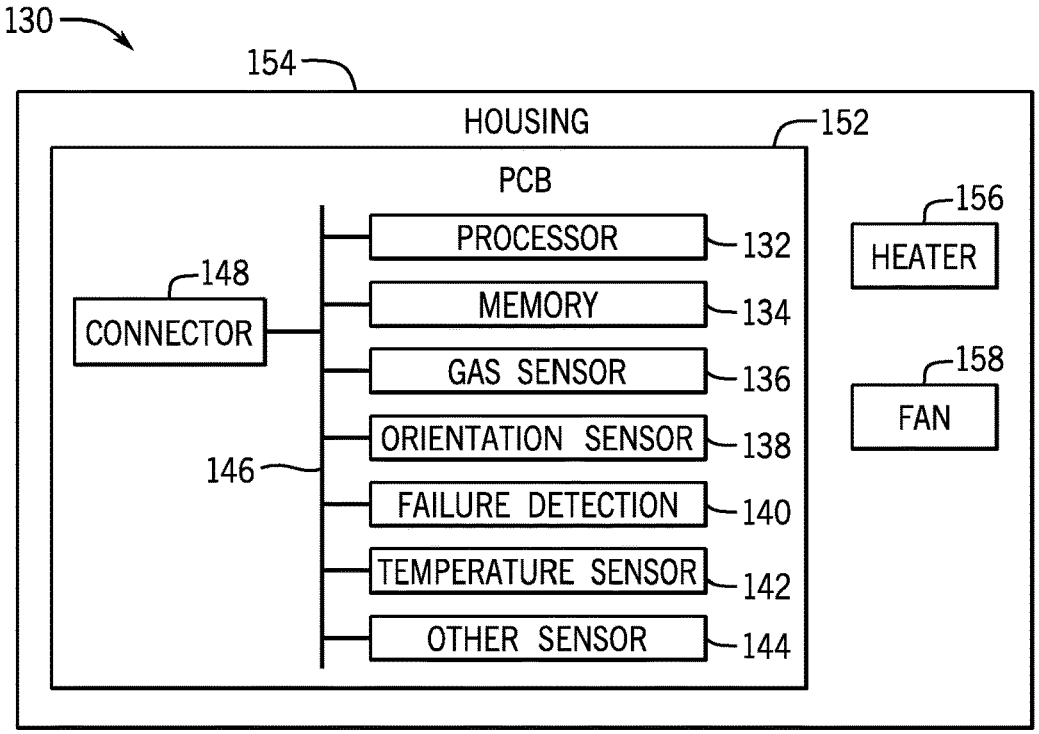
FIG. 7 is a block diagram of an HVAC sensor assembly including a refrigeration gas sensor and an orientation sensor in accordance with one embodiment.

In some embodiments, the air handler 24 or other HVAC equipment with a refrigerant gas sensor also includes an orientation sensor positioned to detect the orientation of the refrigerant gas sensor. By way of example, a sensor assembly 130 having such sensors is shown in FIG. 7. The depicted sensor assembly 130 includes a processor 132, a memory 134, a refrigerant gas sensor 136, and an orientation sensor 138. The refrigerant gas sensor 136, which may be used as the gas sensor 124 or 126 described above, can be a semiconductor sensor, an infrared or other optical sensor, or some other sensor type suitable to detect the refrigerant used in the HVAC system 10. In some embodiments, such refrigerant includes an A2L refrigerant (e.g., R-32 or HFO-1234yf), another mildly flammable refrigerant, or an A1 refrigerant (e.g., R-410a or R-22). Although a single refrigerant gas sensor 136 may be used, in some instances the sensor assembly 130 includes multiple refrigerant gas sensors 136, such as two, three, four, or five refrigerant gas sensors 136, for redundancy or increased sensitivity. The multiple refrigerant gas sensors 136 may be of the same type or of different types.

The orientation sensor 138 is coupled to detect the orientation of the refrigerant gas sensor 136. In FIG. 7, the refrigerant gas sensor 136 and the orientation sensor 138 are fixed to a shared circuit board (i.e., printed circuit board 152) such that rotation of the circuit board changes the orientation of both sensors 136 and 138. In other instances, the sensors 136 and 138 may be attached to some other shared body, or the orientation sensor 138 may be attached to or incorporated into the gas sensor 136. The orientation sensor 138 can take any suitable form but in some embodiments includes a tilt sensor or an accelerometer. The orientation sensor 138 can be a two-dimensional sensor or a three-dimensional sensor to provide sensing in multiple rotational directions, although a single-axis sensor could be used (whether alone or with one or more additional single-axis sensors to sense in additional rotational directions) in other instances.

The sensor assembly 130 can also include other sensors. In the embodiment shown in FIG. 7, these include a failure detection sensor 140, a temperature sensor 142, and one or more other sensors 144, such as a position sensor, a pressure sensor, a vibration sensor, or a humidity sensor. A shared bus 146 connects the various operating components on the printed circuit board 152 to each other and to a connector 148 that facilitates wired or wireless communication between the sensor assembly 130 and another component, such as a control board of the air handler 24.

The printed circuit board 152 can be disposed within a housing 154. Additional devices, such as a heater 156 and a fan 158, may also be disposed in the housing 154. In some instances, the heater 156 is used to control (e.g., prevent or reduce) condensation on the refrigerant gas sensor 136 or within the housing 154. The fan 158 can be used to circulate air through vents in the housing 154 to facilitate detection of leaked refrigerant with the refrigerant gas sensor 136. In other embodiments, the printed circuit board 152, or the sensors themselves, could be mounted directly in the air handler 24 or other equipment without the housing 154. The sensor assembly 130 can be installed in HVAC equipment in a manufacturing facility or by a technician in the field.

Figure 8:
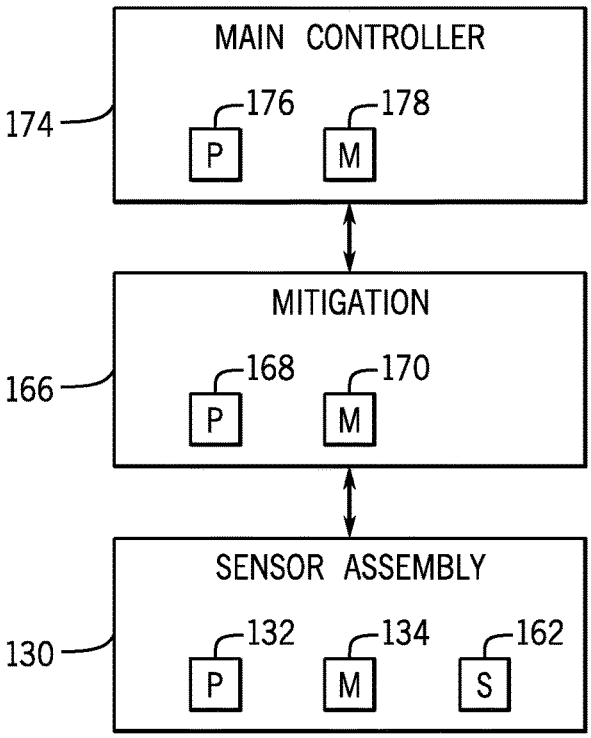
FIG. 8 is a block diagram of a control system for an air handler or other HVAC system in accordance with one embodiment.

Parameters sensed by the sensor assembly 130 may be used to control operation of the air handler 24 or of other components of an HVAC system. In one embodiment generally depicted in FIG. 8, a control system for the air handler 24 includes the sensor assembly 130, a mitigation controller 166, and a main controller 174. As described above, the sensor assembly 130 includes a processor 132, a memory 134, and various sensors that are collectively represented as sensors 162 in FIG. 8 for simplicity. Although the sensors 162 could include each of the sensors 136, 138, 140, 142, and 144 above, fewer of these sensors may be included in some instances.

The mitigation controller 166 and main controller 174 are examples of electronic controllers 122 and may be provided as circuitry on printed circuit boards. The mitigation controller 166 includes a processor 168 and a memory 170, while the main controller 174 (e.g., a main control board) includes a processor 176 and memory 178. The memories 170 and 178, such as flash memory or electrically erasable programmable read-only memory (EEPROM), store instructions executed by the processors 168 and 176 to facilitate control of the air handler 24 or other HVAC components. As described in greater detail below, such control includes taking corrective actions based on sensor readings in some embodiments.

The sensor assembly 130 communicates signals representative of sensor readings to the mitigation controller 166. These signals may be raw sensor data or preprocessed sensor data (e.g., preprocessed by processor 132), which can be analyzed by the mitigation controller 166 to determine whether some action should be taken. For instance, in some embodiments in which the sensor assembly 130 includes a refrigerant gas sensor 136 and an orientation sensor 138, the mitigation controller 166 receives a signal representative of the orientation of a refrigerant gas sensor 136 from the sensor assembly 130 and determines whether the refrigerant gas sensor 136 is in a desired orientation. If the refrigerant gas sensor 136 is not properly oriented, the mitigation controller 166 can take a corrective action, such as by preventing operation of the blower fan, compressor 46, or heating elements. The mitigation controller 166 can send command signals directly to the blower fan, compressor, heating elements, or other operating components of the HVAC system in some embodiments. In others, the mitigation controller 166 can send an error signal to the main controller 174, which can then send command signals to appropriate operating components. Readings from other sensors, such as sensors 140, 142, or 144 of the sensor assembly 130 or a position sensor 250 (FIGS. 16 and 17), may also or instead be used by the mitigation controller 166 to detect an anomaly and trigger a corrective action in the HVAC system.

As noted above, a corrective action may include preventing operation of one or more components of the HVAC system. An example of this includes entering a lockout mode (e.g., a blower lockout mode, a compressor lockout mode, an ignition lockout mode, or an electric heating lockout mode) while refrigerant is detected by the refrigerant gas sensor 136 or while the refrigerant gas sensor 136 is not properly oriented or positioned. In another example, corrective action includes closing one or more valves, such as the metering device 80, to prevent flow of refrigerant through the system (e.g., blocking flow of refrigerant to an indoor coil 38 or an outdoor coil). And in at least some instances the corrective action is automatically performed by the control system in response to a sensor reading indicating an undesirable condition, such as those described herein. As one further example, in response to detecting that the refrigerant gas sensor 136 is not properly oriented, the corrective action taken may be automatically sending an actuation signal to an actuator to move the gas sensor 136 from an improper orientation to a proper orientation (i.e., a self-correcting orientation system).

Further, the mitigation controller 166 could be omitted in some instances and its functionality incorporated into one or both of the sensor assembly 130 and the main controller 174. For example, the sensor assembly 130 (via processor 132 executing instructions stored in memory 134) could be used to identify errors or undesirable conditions from sensor outputs and communicate such information to the main controller 174, which can then take suitable corrective action.

Figure 9:
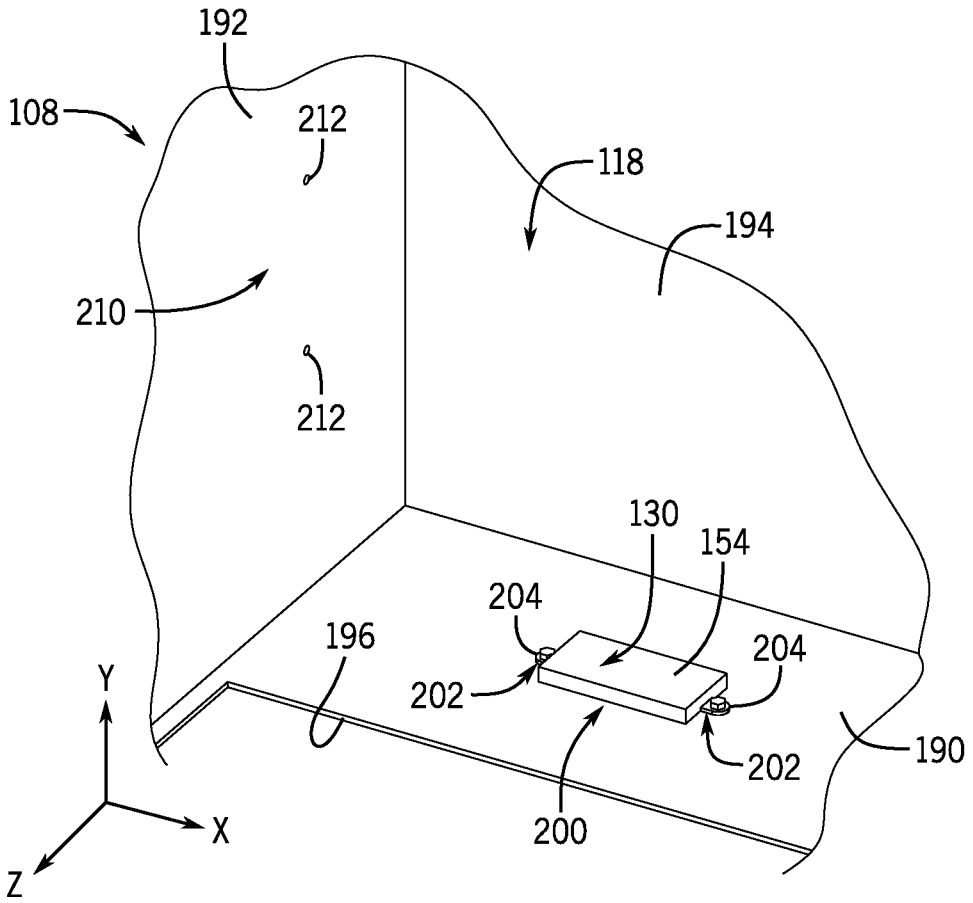
FIG. 9 is a perspective view of a sensor assembly installed in a horizontal orientation at a first location in an HVAC system housing in accordance with one embodiment.

An example of a sensor assembly 130 installed inside an HVAC system housing is depicted in FIG. 9. Although presently shown in a heat exchanger cabinet 108, the sensor assembly 130 could be installed elsewhere, such as in another cabinet, housing, or duct. The portion of the cabinet 108 depicted in FIG. 9 includes walls 190, 192, and 194, but it will be appreciated that the cabinet 108 may include additional walls. The cabinet 108 may have a rectangular prism shape with six walls, for instance. Some walls, such as walls at two opposing ends, include openings or apertures 196 to facilitate air flow through the cabinet 108. In FIG. 9, the sensor assembly 130 is installed at a first location 200 on an inner face of the wall 190, between an aperture 196 and the wall 194. The sensor assembly 130 can be installed in any suitable manner, but in FIG. 9 the wall 190 includes mounting holes 202, the housing 154 of the sensor assembly 130 includes mounting tabs 204, and fasteners 206 (e.g., screws) attach the housing 154 to the wall 190 via the mounting holes 202 and tabs 204. The cabinet may have additional mounting locations for the sensor assembly 130. A second location 210 with mounting holes 212 is shown on the wall 192 as one example, but other locations may be similarly provided elsewhere on or within the cabinet.

Figure 10:
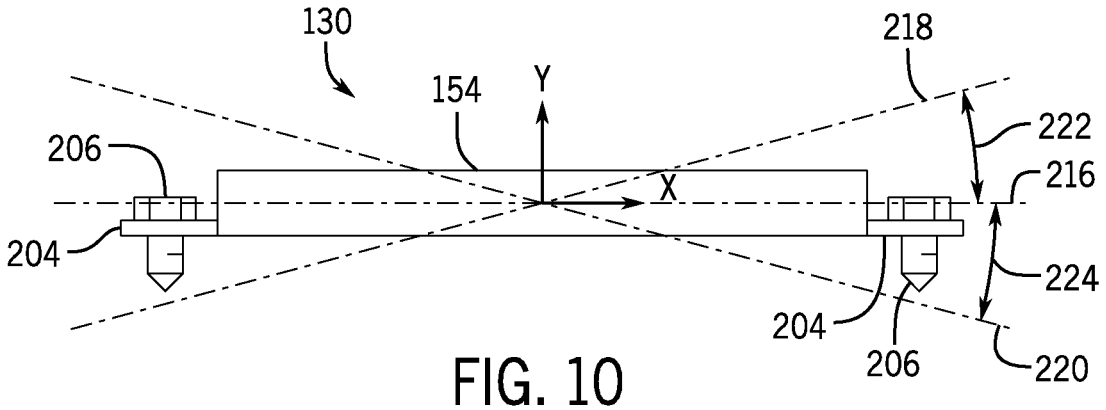
FIG. 10 is a front elevational view of the sensor assembly of FIG. 9 in a horizontal orientation.
Figure 11:
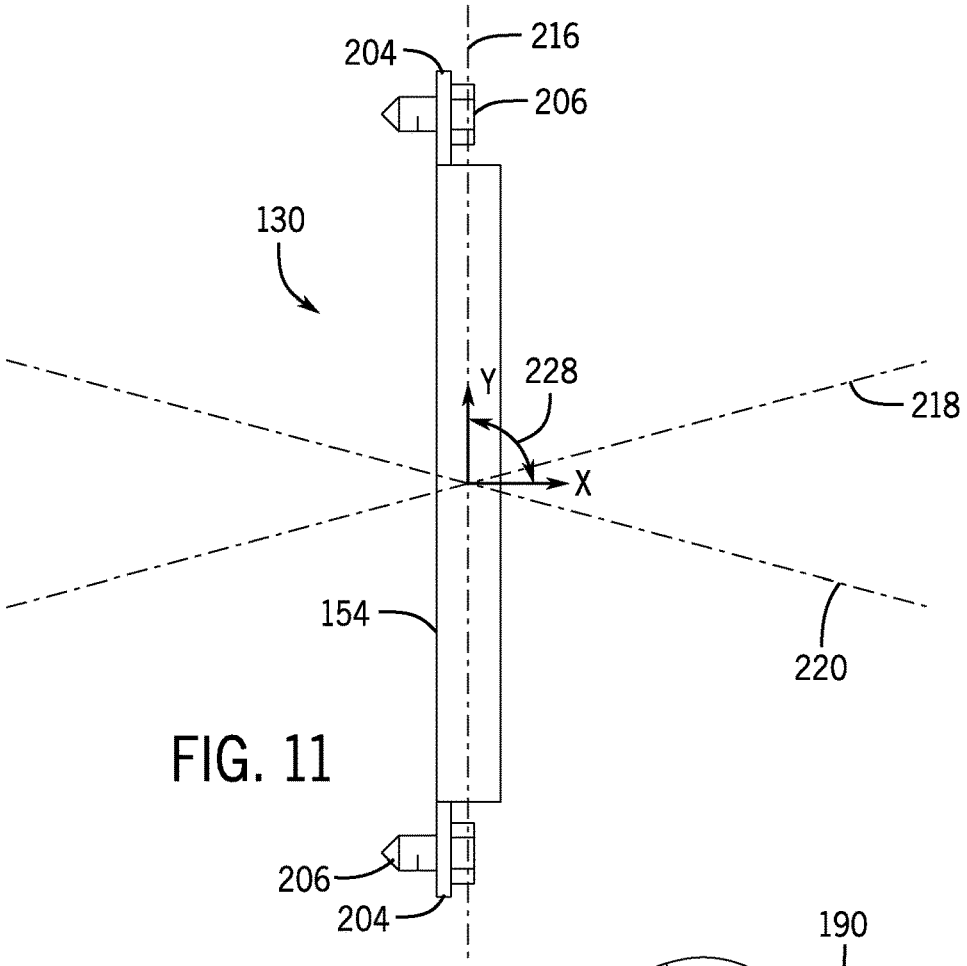
FIG. 11 is a front elevational view of the sensor assembly of FIG. 9 in a vertical orientation.

As noted above, the sensor assembly 130 includes a refrigerant gas sensor 136 and an orientation sensor 138. When the cabinet 108 is installed in an upright orientation like that of FIG. 9, in which the direction of mass air flow through the cabinet 108 is upward or downward through the aperture 196, the sensor assembly 130 at the first location 200 is positioned in a horizontal orientation, such as shown in FIG. 10, with the housing 154 generally lying in the horizontal X-Z plane. But if the cabinet 108 of FIG. 9 were instead installed horizontally (e.g., horizontal left or horizontal right), the sensor assembly 130 at the first location 200 would be positioned in a vertical orientation (e.g., in the Y-Z plane), such as shown in FIG. 11.

In some instances, the refrigerant gas sensor 136 of the sensor assembly 130 may be most sensitive when the sensor assembly 130 is in a horizontal orientation. In others, the gas sensor 136 may be most sensitive when the sensor assembly 130 is in a vertical orientation or in some other orientation. If the gas sensor 136 is most sensitive in an orientation that is neither vertical nor horizontal, the gas sensor 136 may still be more sensitive in one of the vertical or horizontal orientations than in the other.

As noted above, the orientation sensor 138 is used in some embodiments to detect the orientation of the refrigerant gas sensor 136 and determine whether the gas sensor 136 is in a desired orientation. Detecting the orientation of the refrigerant gas sensor 136 can include sensing the orientation of the refrigerant gas sensor 136 itself or the orientation of the sensor assembly 130 having the refrigerant gas sensor 136 (e.g., with the gas sensor 136 installed at a known orientation with respect to the housing 154). Again, in some instances the gas sensor 136 is most sensitive when the sensor assembly 130 is positioned in a horizontal orientation like that shown in FIG. 10. In this example, the longitudinal axis 216 of the sensor assembly 130 is shown along the X-axis, though the axis 216 could instead run along the Z-axis (perpendicular to both the X-axis and the Y-axis) or lie elsewhere within the X-Z plane perpendicular to the Y-axis.

Although the gas sensor 136 may be most sensitive in a specific orientation (e.g., horizontal in FIG. 10), in at least some instances a desired orientation of the gas sensor 136 may be any orientation within a range of orientations deemed to be acceptable. In FIG. 10, for instance, a range of acceptable orientations is generally represented by threshold lines 218 and 220, which are angularly displaced from the X-axis by threshold angles 222 and 224. Although angles 222 and 224 are depicted in FIG. 10 as being about 15 degrees, these threshold angles may have other magnitudes (e.g., 5, 10, 20, or 25 degrees) depending on the gas sensor 136 used and the desired sensitivity.

The orientation of the gas sensor 136 may be determined with the orientation sensor 138 and compared with the desired orientation. For example, if the sensor assembly 130 is horizontal, as in FIG. 10, or is rotated about the Z-axis (normal to the drawing sheet of FIG. 10) by an amount that does not exceed the angle 222 or 224, such that the axis 216 remains between the X-axis and the line 218 or 220, the orientation may be measured with the orientation sensor 138 and compared with a threshold (e.g., an angular range that is between lines 218 and 220 and includes the horizontal axis) to determine that the orientation is proper in that it falls within a desired range of orientations. Conversely, if the sensor assembly 130 is rotated about the Z-axis by an amount greater than the angle 222 or 224 (e.g., by angle 228 in FIG. 11), such that the axis 216 does not fall between the X-axis and the line 218 or 220, the orientation may be measured with the orientation sensor 138 and compared with the threshold to determine that the orientation is improper and does not fall within the desired range.

While orientation with respect to one axis is described above, some embodiments may measure orientation in multiple axes. By way of example, the orientation sensor 138 could be used to measure the inclination or declination of the gas sensor 136 with respect to the X-axis and the Z-axis and determine whether the gas sensor 136 is properly oriented (i.e., within a desired range for each axis). Threshold angles 222 and 224 for a first axis (e.g., the X-axis) may be the same or differ from those of a second axis (e.g., the Z-axis).

Figure 12:
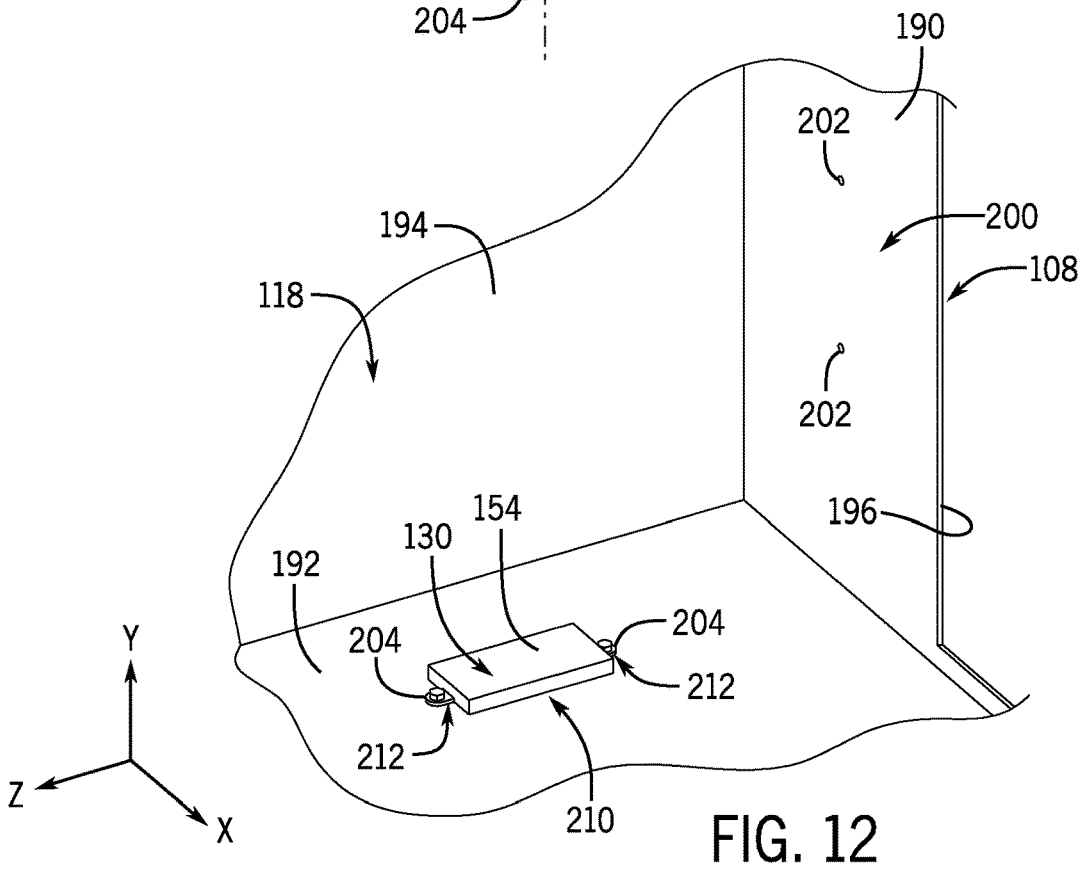
FIG. 12 depicts the sensor assembly of FIGS. 9-11 installed in a horizontal orientation at a second location in the HVAC system housing in accordance with one embodiment.

In at least some instances, the HVAC system is controlled based on the orientation of the refrigerant gas sensor 136—allowing normal operation when the gas sensor 136 is at an acceptable orientation and taking corrective action when the gas sensor 136 is not at an acceptable orientation. As noted above, examples of such corrective action include stopping or preventing operation of the blower, the compressor, a heating element, or other component. If the gas sensor 136 would not be in a desired orientation when installed at one location, the gas sensor 136 may be installed at another location that allows a desired orientation. In FIG. 12, for instance, the cabinet 108 is horizontally installed and the sensor assembly 130 with the gas sensor 136 is installed at the second location 210, rather than the first location 200, so that the gas sensor 136 is in a desired orientation (e.g., to increase sensitivity). If the cabinet 108 were positioned on its back, resting on wall 194, the sensor assembly 130 could be installed on the wall 194 to maintain a horizontal orientation of the gas sensor 136. If the sensor assembly 130 is not at a correct location or orientation in an installed HVAC system, a field technician may reposition the sensor assembly 130 to a proper location and orientation.

Figure 13:
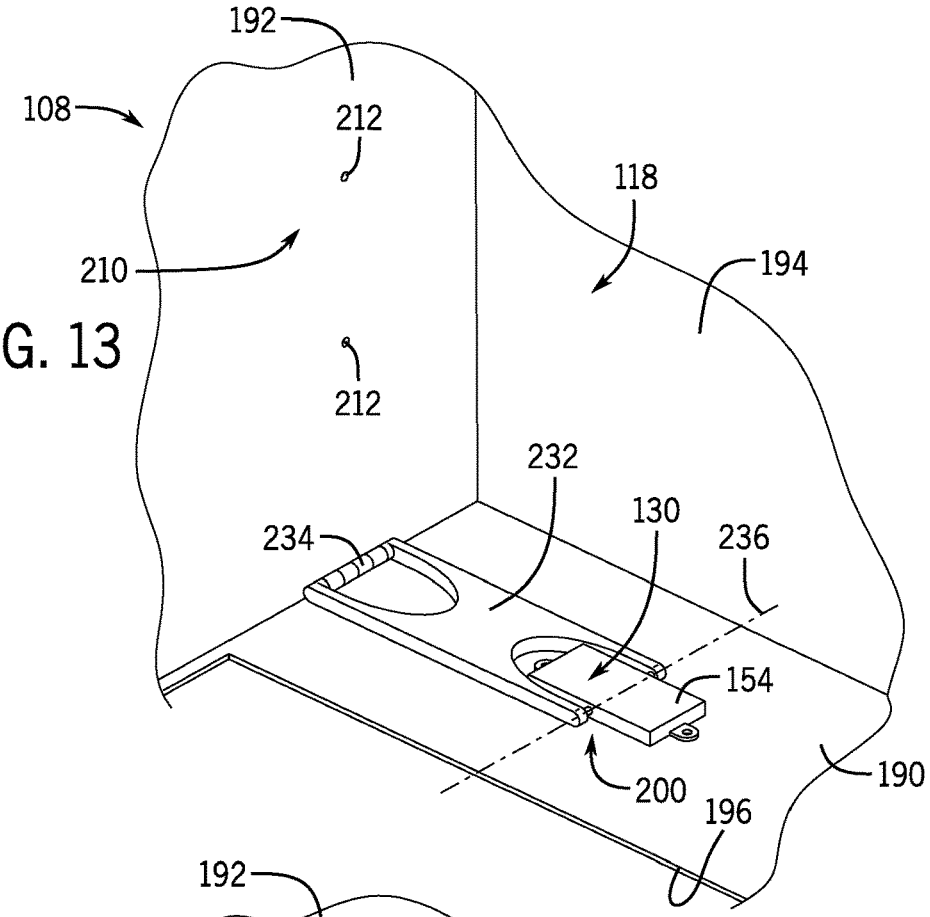
FIG. 13 is a perspective view of the sensor assembly mounted on a swing arm and positioned in a horizontal orientation at a first location in an HVAC system housing in accordance with one embodiment.
Figure 14:
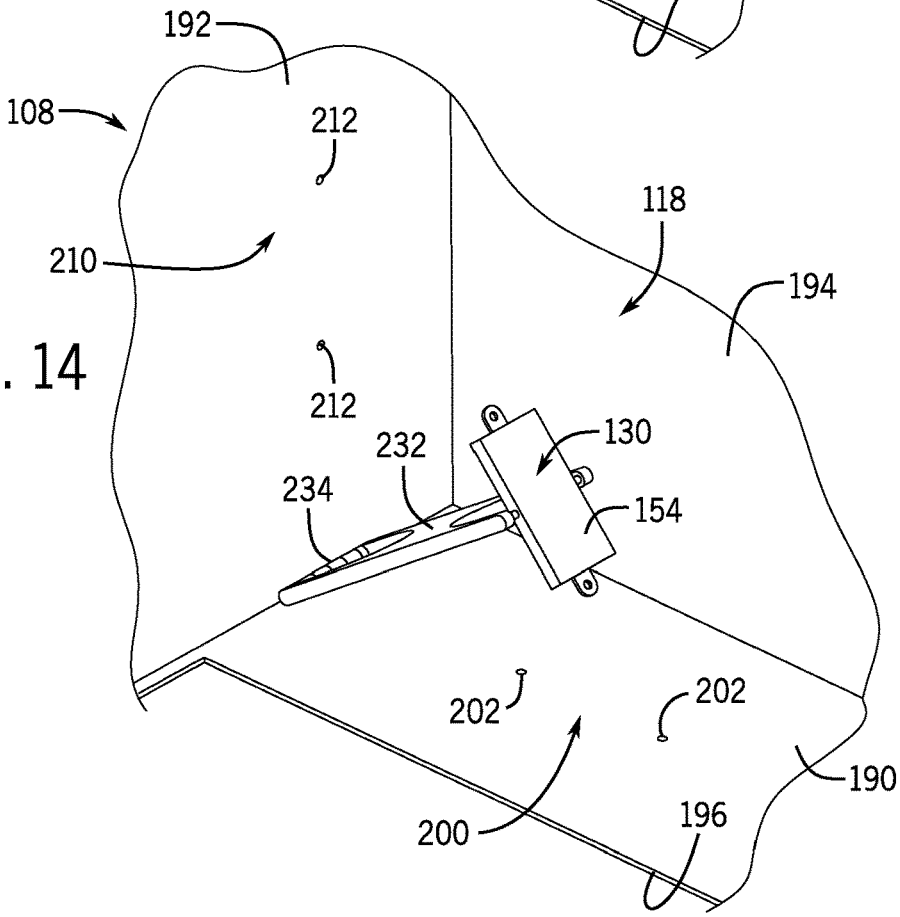
FIG. 14 is a perspective view of the sensor assembly of FIG. 13 as it is swung from the first location in the HVAC system housing to a second location in the HVAC system housing in accordance with one embodiment.
Figure 15:
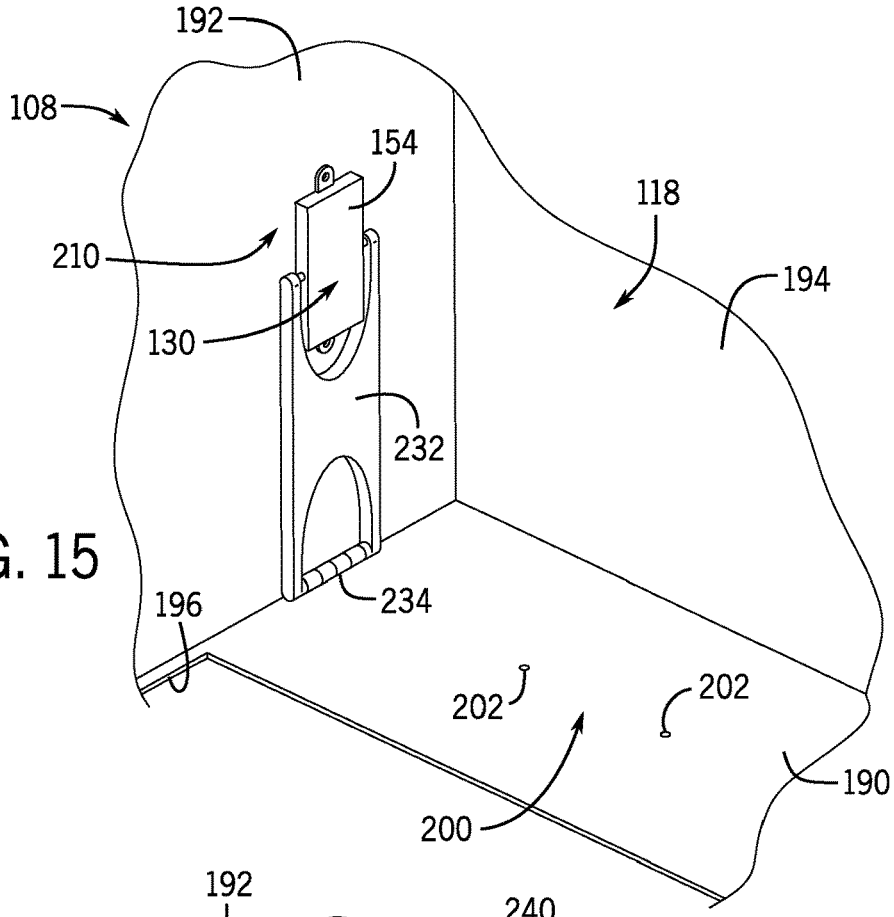
FIG. 15 is a perspective view of the sensor assembly of FIGS. 13 and 14 positioned in a vertical orientation at the second location in the HVAC system in accordance with one embodiment.

In some embodiments, the sensor assembly 130 includes a swing body (e.g., housing 154) that facilitates rotation of the sensor assembly 130 into multiple locations or orientations. In FIGS. 13-15, for instance, the housing 154 of the sensor assembly 130 is mounted on a swing arm 232 that can swing, via a hinge 234, between the first position 200 and the second position 210. The depicted swing arm 232 is attached to the housing 154 in a manner that allows the housing 154 to pivot about axis 236, which allows the underside of the housing 154 to be positioned along the wall 190 when at the first location 200 and along the wall 192 when at the second location 210. The sensor assembly 130 could be fastened in the first location 200 or the second location 210 via the mounting holes 202 or 212 or held in place in some other manner. In other instances, the sensor assembly 130 may simply rest in place without fastening the housing 154 at the first or second location.

Figure 16:
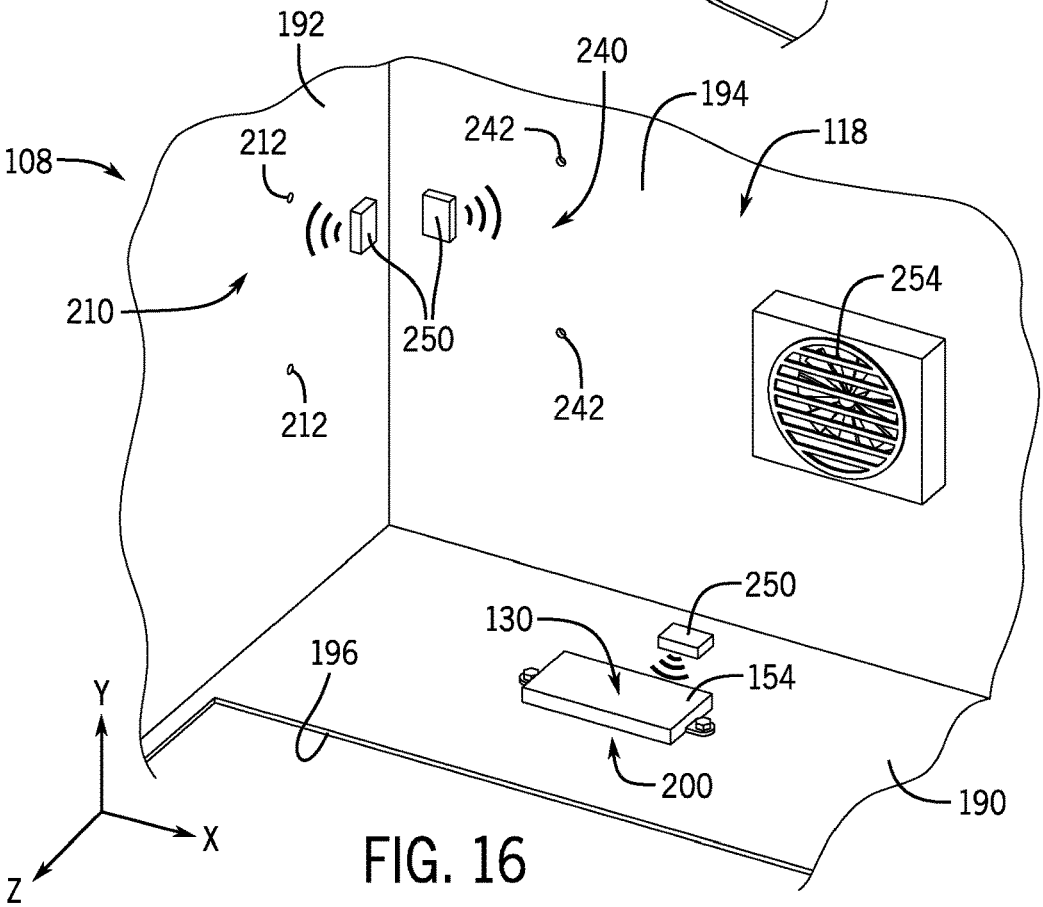
FIG. 16 depicts the sensor assembly installed in a HVAC system housing with position sensors for detecting the location of the sensor assembly in accordance with one embodiment.

Another embodiment of the cabinet 108 is depicted in FIG. 16 as having an additional mounting location 240 with mounting holes 242. The sensor assembly 130 can be positioned at the first location 200, the second location 210, the additional location 240, or any other suitable location. The suitability of a location may depend on the sensitivity and orientation of the sensor assembly 130 in that location, as discussed above, as well as its position with respect to circulation patterns within the cabinet 108. The sensor assembly 130 can be positioned based on testing or modeling of flow of a leaking gas refrigerant within the cabinet 108 for improved sensitivity and detection of leaking gas refrigerant in operation.

Figure 17:
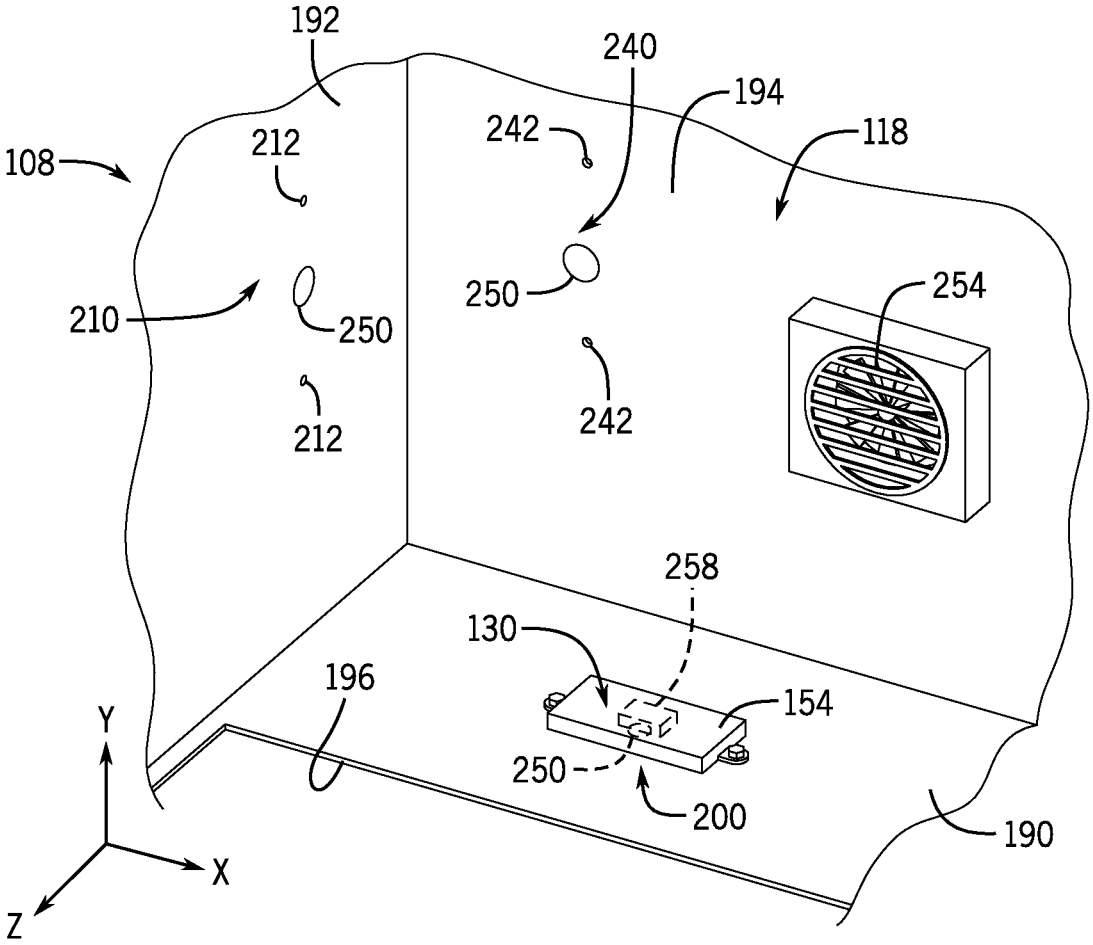
FIG. 17 depicts the sensor assembly installed in a HVAC system housing with tags and readers as position sensors for detecting the location of the sensor assembly in accordance with one embodiment.

In this embodiment, position sensors 250 are used to detect the presence of the sensor assembly 130 at a given mounting location (e.g., the first location 200 in FIG. 16). The position sensors 250 are generally represented in FIG. 16 as proximity sensors. These proximity sensors can take any suitable form, such as inductive proximity sensors, capacitive proximity sensors, ultrasonic proximity sensors, or infrared proximity sensors. But other forms of position sensors 250 may also or instead be used. In FIG. 17, for instance, the position sensors 250 are tags, such as radio-frequency identification (RFID) tags or near-field communication (NFC) tags, that can be read by a reader 258 of the sensor assembly 130. Each tag can be encoded with a unique identifier representing the location at which the tag is placed. The tags may be active or passive. When the sensor assembly 130 is installed at a given location (e.g., location 200, 210, or 240), the reader 258 can read the tag at that location and allow the installation location of the sensor assembly 130 to be determined. In other instances, the sensor assembly 130 includes a tag and each location includes a reader 258 able to detect whether the sensor assembly is at the location. The detected position can be communicated to control circuitry, such as the mitigation controller 166 or the main controller 174.

A desired location for the sensor assembly 130 (or the refrigerant gas sensor 136 alone) may be determined in any suitable manner, such as based on the ability of the gas sensor 136 to detect leaking gas refrigerant at the desired location compared to other potential locations. The detected location of the sensor assembly 130 may be compared with the desired location. In at least some instances, this comparison is made by a processor of the mitigation controller 166 or the main controller 174. If the sensor assembly 130 is not detected at the desired location, corrective action may be taken, such as entering a lockout mode, outputting an error indication, or taking some other corrective action described above. Once the sensor assembly 130 is provided at the desired location and any other errors (e.g., improper orientation) are corrected, normal operation of the HVAC system may begin or resume.

In some embodiments, the orientation of the cabinet 108 or other component having the refrigerant gas sensor 136 is detected, such as with an orientation sensor 138, and the desired location of the gas sensor 136 is determined based on the orientation of the cabinet 108 or other component. By way of example, if it is desired to have the gas sensor 136 along the bottom of the cabinet 108, an orientation sensor 138 can be used to detect the orientation of the cabinet, the lowermost surface (e.g., wall 190, 192, 194, etc.) may be determined from the detected orientation, and the presence of the gas sensor 136 (or sensor assembly 130) at a location along that lowermost surface may be required before allowing normal operation of the HVAC system. Some embodiments may include a fan 254, such as shown in FIGS. 16 and 17, to circulate air and facilitate detection of leaked refrigerant with the gas sensor 136.

Figure 18:
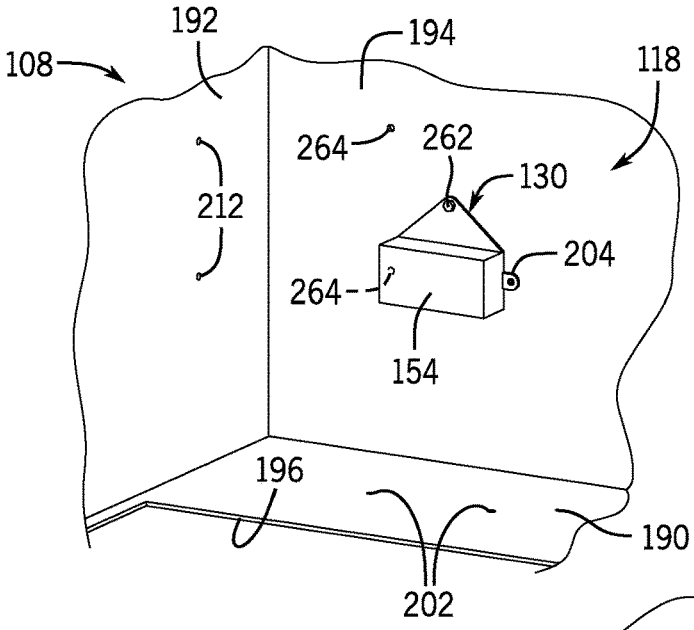
FIG. 18 depicts an upright HVAC system housing and a sensor assembly mounted on a pivot in accordance with one embodiment.
Figure 19:
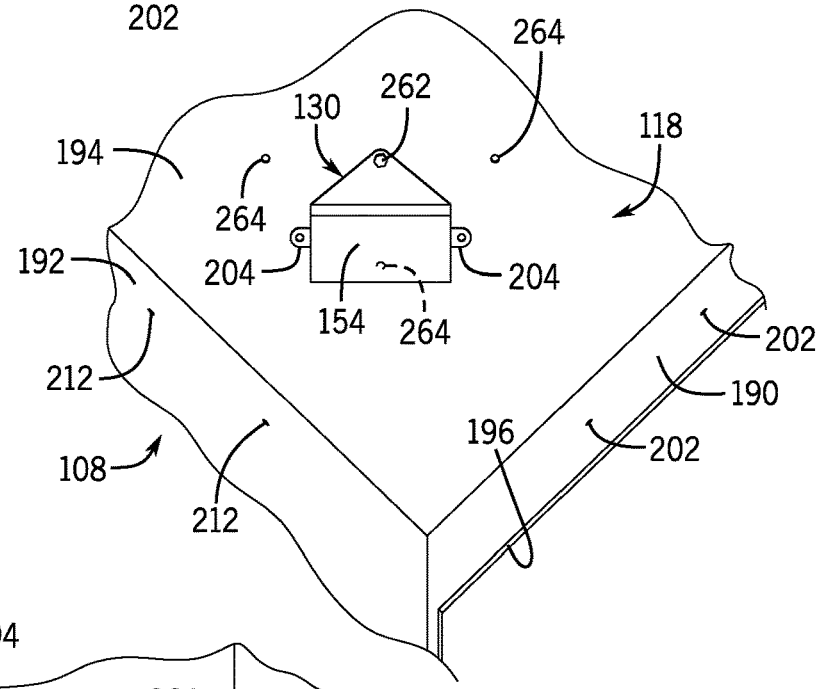
FIG. 19 depicts the sensor assembly and HVAC system housing of FIG. 18 as the housing is rotated from the upright orientation toward a horizontal orientation and the sensor assembly turns about and hangs from the pivot in accordance with one embodiment.
Figure 20:
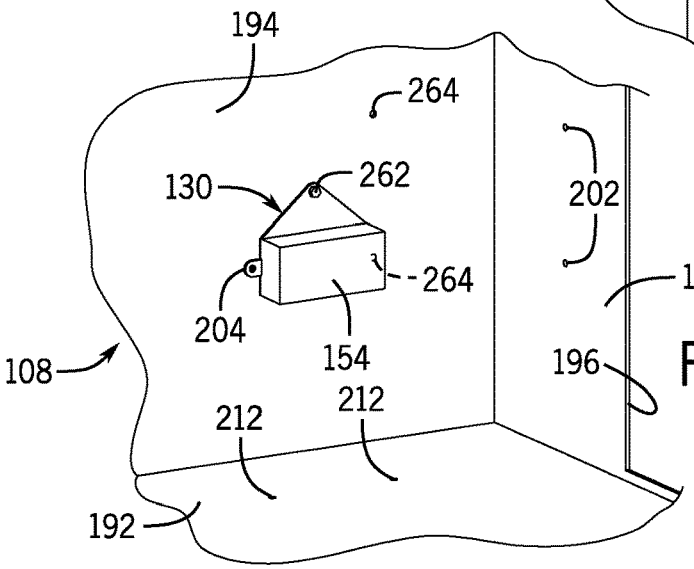
FIG. 20 depicts the HVAC system housing of FIG. 18 in a horizontal orientation with the sensor assembly hanging from the pivot in accordance with one embodiment.

Another example of a sensor assembly 130 including a swing body carrying a refrigerant gas sensor 136 is depicted in FIGS. 18-23. This sensor assembly 130 may be installed in a cabinet 108, such as shown in FIGS. 18-20, or attached to some other HVAC system component. The depicted sensor assembly 130 is mounted to a wall of the cabinet 108 via a pivot 262 (e.g., a stud). While shown here mounted to the wall 194 within the cabinet 108, the sensor assembly 130 could be mounted on a different wall in other instances. The pivot 262 allows the swing body housing 154 to swing between multiple orientations within the cabinet 108.

In FIG. 18, the cabinet 108 is depicted in an upright orientation with the sensor assembly 130 in a first resting position suspended from the pivot 262. FIG. 19 generally shows the cabinet 108 as it is being turned counterclockwise from the upright orientation of FIG. 18 to a horizontal orientation shown in FIG. 20. As the cabinet 108 is turned, the sensor assembly 130 hangs from and, under the force of gravity, freely turns about the pivot 262 (like a pendulum) such that the sensor assembly 130 changes position relative to the cabinet 108 and ends in a second resting position in FIG. 20. In this manner, the orientation of the gas sensor 136 of the sensor assembly 130 remains unchanged (relative to the direction of gravity) whether the cabinet 108 is installed in an upright or horizontal configuration. Although two resting positions are shown by FIGS. 18 and 20, the sensor assembly 130 could rest in other positions, such as when the cabinet 108 is turned to rest on a wall that is opposite the wall 190 or 192.

The sensor assembly 130 can be fastened in place via mounting holes 264, mounting tabs 204, and fasteners 206. In one embodiment, the sensor assembly 130 is allowed to freely rotate about pivot 262 during installation of the cabinet 108 in an HVAC system. Once the cabinet 108 is installed in a desired configuration (e.g., upright or horizontal), the sensor assembly 130 could be fastened in place to prevent rotation or could be allowed to simply hang from the pivot 262. In another embodiment, the sensor assembly 130 can be fastened to prevent rotation during installation and then, if desired, unfastened to allow the sensor assembly 130 to swing about the pivot 262 into a desired position and orientation. In still another embodiment, the sensor assembly 130 may be added after the cabinet 108 is installed.

Figure 21:
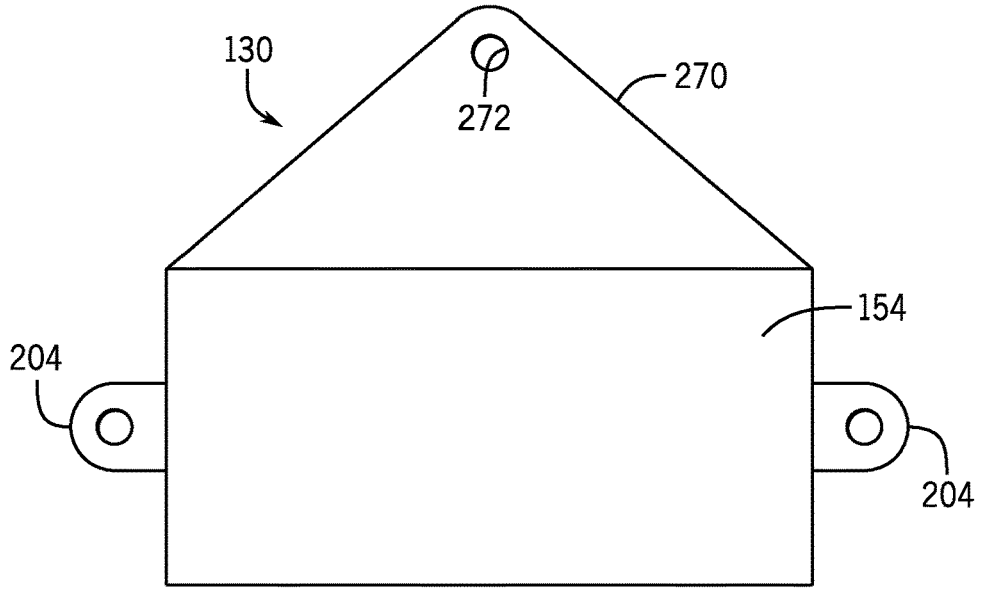
FIG. 21 is a front elevational view of the sensor assembly of FIGS. 18-20 in accordance with one embodiment.
Figure 22:
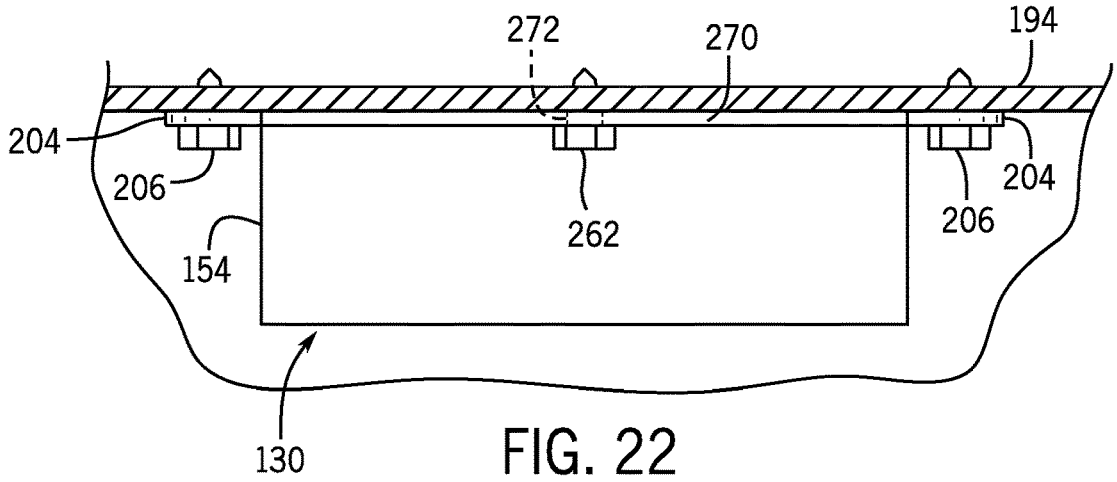
FIG. 22 is a top plan view showing the sensor assembly of FIG. 21 coupled to a wall of the HVAC system housing in accordance with one embodiment.
Figure 23:
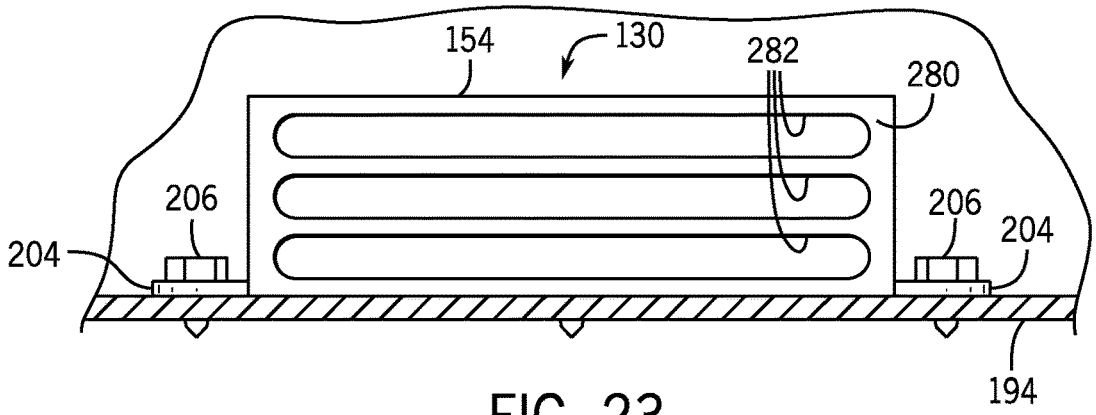
FIG. 23 is a bottom plan view showing the sensor assembly of FIG. 21 coupled to a wall of the HVAC system housing in accordance with one embodiment.

Exterior features of the sensor assembly 130 of FIGS. 18-20 are shown in more detail in FIGS. 21-23. FIG. 21 is a front elevational view depicting the housing 154 of the sensor assembly 130 with a hang tab 270 having a mounting hole 272 for receiving the pivot 262. FIG. 22 is a top plan view showing the sensor assembly 130 coupled to the wall 194 by the pivot 262, extending through the mounting hole 272, and by fasteners 206. The fasteners 206 may be omitted, or unfastened from the wall 194, to allow rotation of the sensor assembly 130 about the pivot 262, as discussed above. FIG. 23 is a bottom plan view showing a bottom face 280 of the housing 154 having vents 282. In at least some instances, these vents allow air (and any other gases, such as leaked refrigerant) to flow into the housing 154, aid in heat dissipation, and allow condensation, if any, to drain from the housing 154. Although shown in FIG. 23 as three vents 282 in the bottom face 280, the housing 154 may include any suitable number of vents in any one or more surfaces of the housing 154. And it will be appreciated that the housing 154 of other sensor assemblies 130, such as those described elsewhere herein, may also include one or more vents for the above purposes.

Figure 24:
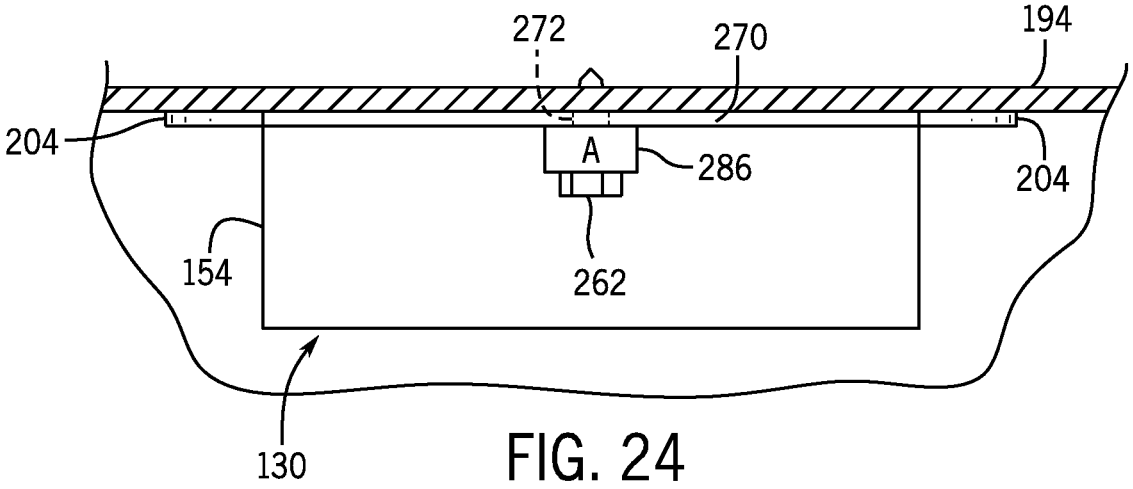
FIG. 24 is a top plan view of a sensor assembly like that of FIGS. 18-23 with the addition of an actuator for changing the orientation of the sensor assembly in accordance with one embodiment.

In some embodiments, one or more actuators can be used to change the orientation or position of the sensor assembly 130. By way of example, FIG. 24 depicts a sensor assembly 130, like that of FIGS. 18-23, with an actuator 286 positioned to drive rotation of the housing 154 about the pivot 262. The actuator 286 can be a stepper motor, a servomotor, or any other suitable actuator. In one embodiment, the actuator 286 enables automatic orientation of the sensor assembly 130 to position the refrigerant gas sensor 136 in a desired orientation. For example, the orientation sensor 138 can determine the orientation of the gas sensor 136 and, in response to detection that the gas sensor 136 is not at an acceptable orientation, the actuator 286 can be operated (e.g., via an actuation signal from the mitigation controller 166 or main controller 174) to turn the housing 154 and reorient the gas sensor 136 to a desired orientation. Various actuators may be used in other embodiments, such as rotary or linear actuators, each of which may be electric actuators or fluid actuators. In some instances, linear actuators may be coupled to a refrigerant gas sensor 136 or a sensor housing 130 (e.g., linear actuators added as two or three legs to a sensor housing 154 like that of FIG. 9) to facilitate orientation in an automated manner.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An HVAC system comprising:

a heat exchanger coil installed within a housing, the heat exchanger coil operable to exchange heat with air in the housing via a refrigerant passing through the heat exchanger coil;

an HVAC sensor assembly installed within the housing, the HVAC sensor assembly including:

a refrigerant gas sensor; and an orientation sensor positioned to detect an orientation of the refrigerant gas sensor;

an air handler having a blower; and a controller configured to prevent an operation of the air handler in response to detection that the refrigerant gas sensor is not in a desired orientation.

2. The HVAC system of claim 1, wherein the blower is installed in the housing in which the heat exchanger coil is installed.

3. The HVAC system of claim 1, wherein the air handler includes a gas furnace.

4. The HVAC system of claim 1, wherein the HVAC sensor assembly includes a swing body that carries the refrigerant gas sensor and the orientation sensor and is configured to swing between multiple orientations within the housing.

5. The HVAC system of claim 4, wherein the swing body is mounted to the housing via a pivot to allow the swing body to turn about the pivot.

6. The HVAC system of claim 4, wherein the swing body includes a swing body housing in which the refrigerant gas sensor and the orientation sensor are enclosed.

7. The HVAC system of claim 1, comprising a position sensor installed to detect whether the refrigerant gas sensor is positioned at a desired location within the housing.

8. A system comprising:

an HVAC sensor assembly including:

a refrigerant gas sensor; and an orientation sensor positioned to detect an orientation of the refrigerant gas sensor;

wherein the HVAC sensor assembly includes a swing body that carries the refrigerant gas sensor and the orientation sensor and is configured to swing between multiple orientations within an HVAC cabinet, the multiple orientations including a first desired orientation of the refrigerant gas sensor with respect to the HVAC cabinet in which the swing body sits along a first wall of the HVAC cabinet when the HVAC cabinet is installed in an upright orientation and a second desired orientation of the refrigerant gas sensor with respect to the HVAC cabinet in which the swing body sits along a second wall of the HVAC cabinet, different from the first wall, when the HVAC cabinet is installed in a horizontal orientation.

9. The system of claim 8, wherein the refrigerant gas sensor and the orientation sensor are mounted on a shared printed circuit board.

10. The system of claim 8, wherein the HVAC sensor assembly includes a sensor housing in which the refrigerant gas sensor and the orientation sensor are installed.

11. The system of claim 10, wherein the HVAC sensor assembly includes a heater within the sensor housing.

12. The system of claim 8, wherein the HVAC sensor assembly is installed in the HVA cabinet.

13. A method comprising:

using an orientation sensor to determine an orientation of a refrigerant gas sensor within an HVAC system;

comparing the determined orientation of the refrigerant gas sensor with a desired orientation of the refrigerant gas sensor;

detecting, from the comparison of the determined orientation of the refrigerant gas sensor with the desired orientation of the refrigerant gas sensor, that the refrigerant gas sensor is improperly oriented; and controlling operation of the HVAC system based on the comparison of the determined orientation of the refrigerant gas sensor with the desired orientation of the refrigerant gas sensor, wherein controlling operation of the HVAC system based on the comparison of the determined orientation of the refrigerant gas sensor with the desired orientation of the refrigerant gas sensor includes preventing an operation of the HVAC system in response to detecting that the refrigerant gas sensor is improperly oriented.

14. The method of claim 13, wherein comparing the determined orientation of the refrigerant gas sensor with the desired orientation of the refrigerant gas sensor includes determining whether the determined orientation is within a desired range of orientations of the refrigerant gas sensor.

15. The method of claim 13, comprising:

using a location sensor to detect whether the refrigerant gas sensor is positioned at a desired location within the HVAC system; and controlling operation of the HVAC system based on whether the refrigerant gas sensor is positioned at the desired location within the HVAC system.

16. The method of claim 13, comprising:

detecting leaked refrigerant with the refrigerant gas sensor; and preventing an operation of the HVAC system in response to the detection of the leaked refrigerant with the refrigerant gas sensor.

* * * * *